United States Patent [19]

Nishimura

[11] 4,383,707

[45] May 17, 1983

[54] CLOSING DEVICE FOR DOORS AND THE LIKE

[75] Inventor: Tamotsu Nishimura, Osaka, Japan

[73] Assignee: Futaba Kinzoku Kogyo Kabushiki Kaisha, Osaka, Japan

[21] Appl. No.: 233,646

[22] Filed: Feb. 11, 1981

[30] Foreign Application Priority Data

Sep. 22, 1980 [JP] Japan ..... 55-135017[U]

[51] Int. Cl.[3] ..... E05C 3/32

[52] U.S. Cl. ..... 292/110; 292/DIG. 4; 292/129; 292/192

[58] Field of Search ..... 292/110, 122, 129, DIG. 4, 292/191, 192, DIG. 19, 127; 70/103, 104, 131

[56] References Cited

U.S. PATENT DOCUMENTS

| | | | |
|---|---|---|---|
| 3,371,947 | 3/1968 | Gridley | 292/192 X |
| 3,752,519 | 8/1973 | Nordell et al. | 292/129 X |
| 4,227,726 | 10/1980 | Sorimachi | 292/DIG. 4 |

FOREIGN PATENT DOCUMENTS

| | | | |
|---|---|---|---|
| 1188996 | 4/1970 | United Kingdom | 292/DIG. 4 |
| 432266 | 12/1974 | U.S.S.R. | 292/110 |

*Primary Examiner*—Richard E. Moore

*Attorney, Agent, or Firm*—Wenderoth, Lind & Ponack

[57] ABSTRACT

A closing device for doors and the like comprising a spring-projected slider automatically held in a retracted position in a housing by pushing the slider therein, and automatically released therefrom by a further pushing in of the slider. The slider supports a catch which may engage a counterpart catch member by pivoting thereagainst as the slider is retracted; and may be released as the slider is projected.

1 Claim, 11 Drawing Figures

CLOSING DEVICE FOR DOORS AND THE LIKE

The present device relates to a door or cover closing device for audio racks, furniture or other box structures.

There is known a door closer of the type having a slide housed in a casing, wherein a first push on the slider into the casing permits the slider to be locked up in the casing so that the door is securely locked and a second push on the slider removes the lock-up to permit the slider to slide outwardly of the casing so that the door is opened. In such a door closing device, locking up the door through the slider is accomplished by the aid of magnet. Therefore, a difficulty with the known door closer is that door opening operation involves the trouble of separating the opened door from the magnet. Moreover, separation of the door from the magnet involves a shock which may vibrate the door.

The present device contemplates the provision of a door closer which is free from these difficulties.

The accompanying drawings illustrate the embodiments of the present device.

Figure 1:
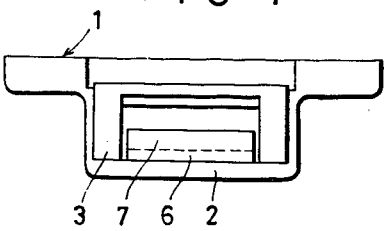
FIG. 1 is a front elevation of a closer embodying the present device.

Referring first to the embodiment of the device shown in FIGS. 1–7 inclusive, reference number 1 indicates a closing device which comprises a casing 2 open at one end and adapted to be attached to a box structure, and a slider 3 disposed in the casing 2 for outward and inward slide movement relative thereto. At 4 there is shown a spring means provided within the casing 2 for urging the slider 3 outwardly of the casing 2. An engagement means 5 having a concave section is provided within the front portion of the slider. At its innermost end the engagement means 5 is pivotally supported on a shaft 6 mounted to the slider 3 between the opposed walls thereof and at the right angle to the direction of slide movement of the slider. The engagement means 5, at the other end thereof, has a catch projection 7 disposed in opposed relation with the front end portion of the slider 3. At this catch projection end the engagement means 5 is swingable with the shaft 6 as a pivot point. Shown at 8 is a locking means adapted to lock up the slider 3 when it is pushed into the casing 2 and to release the slider 3 when it is pushed again. The locking means 8 is disposed on the slider 3 in the casing 2. It comprises a swing plate 9 disposed in parallel relation to the bottom of a recess provided at one side of the inner portion of the slider 3 and pivotally supported, at its end nearer to the open end of the casing 2, by a shaft on the slider 3, and a pin provided upright within the casing 2 and adapted to strike the edge of the swing plate 9, as the slider 3 slides, to allow the plate 9 to swing. The pin 10 is erected in a slot provided on the slider 3 in parallel relation to the direction of slide movement thereof. The swing plate 9 is slightly movable parallel to the axis of the shaft by which it is supported, and has a hook-shaped latch portion, which is bent toward the open end of the casing 2, for engagement with the pin 10. At the inner side of the latch portion 11 there is provided a slope portion 12 extending toward the open end of the casing 2 and rising in the opposite direction relative to the pin 10 so that it may be positioned on the pin 10. The swing plate 9 is urged by spring means 13 toward its edge portion having the latch portion 11. A stopper 14 is provided which stops the swing plate 10 when the slope portion 18 comes to a point where it is positioned on the pin 10. Shown at 15 is a coupling means to be attached to the door or cover of a box structure. Its front end is adapted to be inserted in the slider 3 and has a catch member 16 engageable with the catch projection 7. At 17 there is shown a mounting plate provided at the base of the coupling means 15 for attachment to a door or the like. A box structure and a door are designated as 18 and 19 respectively.

The door closing device is mounted by securing the casing 2 to the inner top wall of the box structure at open end portion thereof, with the slider 3 facing outward. The coupling means 15 is secured to the inner surface of the door through the mounting plate 17 so as to be positioned in face to face relation when the door is closed. As can be seen from FIG. 5, when the door is open, the slider 3 projects outwardly of the casing 2 and the engagement means 5 is inclined downwardly by gravity, with the catch projection 7 positioned outside the slider 3.

Figure 4:
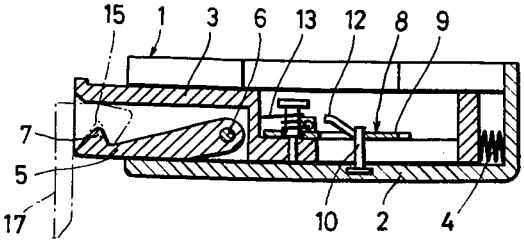
FIG. 4 is a section taken along the line A—A in FIG. 3.
Figure 5:
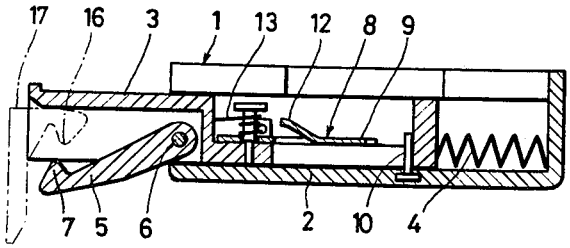
FIG. 5 is a section taken along the line A—A when engagement means are released.
Figure 6:
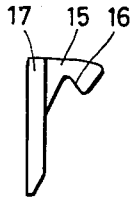
FIG. 6 is a side elevation of coupling means.
Figure 7:
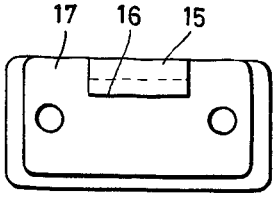
FIG. 7 is a front view of the coupling means.

When the door is closed, as shown by chain lines in FIG. 5, the coupling means 15 enters the slider 3 to push it into the casing 2 against the force of the spring means 4. As the slider 3 enters the casing 2, the engagement means 5 is caused to swing upward through contact with the entrance edge of the casing 2. Then the entry of the slider 3 into the casing 2 is nearly completed, the catch projection 7 engages the counterpart catch member 16 of the coupling means 15, as shown in FIG. 4. Whilst, upon sufficient entry of the slider 3 into the casing 2, the locking means 8 locks up the slider 3, so that the catch projection 7 and counterpart catch member 16 may be held in engagement with each other. Thus, the door is now closed and securely locked.

To open the closed and locked door, what to do is just push the door toward the body of the box structure. Then, the locking means 8 releases the slider 3, which thereupon is caused to slide outwardly of the casing 2 by the force of the spring 4 to open the door. As the slider 3 projects outwardly of the casing 2, the engagement means 5 swings downward to release the coupling means 15, as illustrated in FIG. 5, and the door is ready to be opened. In other words, a mere push on the door allows the coupling means 15 to be completely released from contact with the slider 3 and engagement means 5. So, door opening is a very easy and simple operation.

Figure 2:
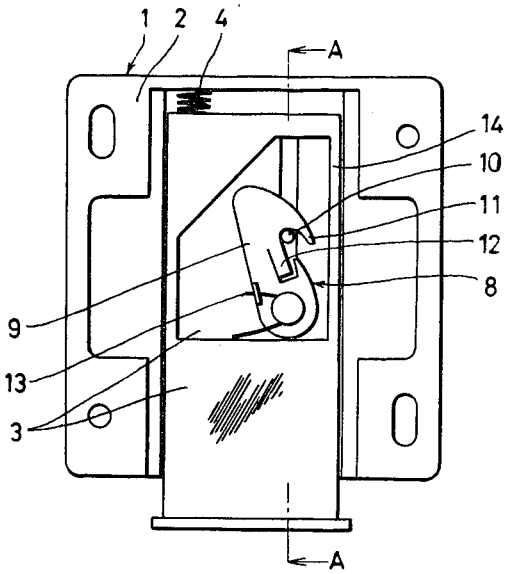
FIG. 2 is a plan view showing the closer as it appears when a slider is pushed into a casing.
Figure 3:
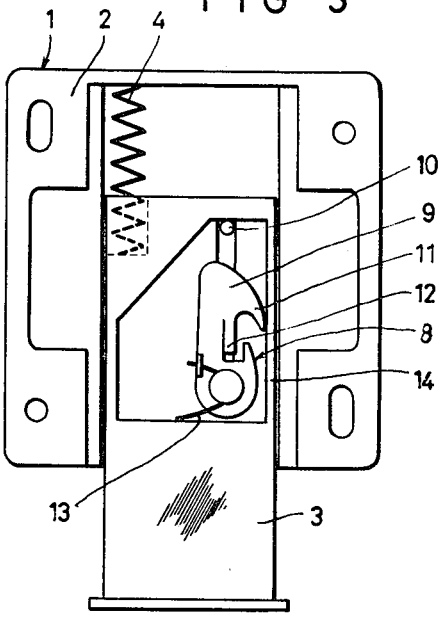
FIG. 3 is a plan view showing the closer as it appears when the slider is projected.

When the slider 3 is released, as FIG. 3 shows, the pin 10 is positioned at the inner end of recess portion of the slider 3. As the slider 3 is pushed into the casing 2 via the door, the edge of the swing plate 9 strikes the pin 10 so that the swing plate 9 swings against the force of the spring 13. And as the latch portion 11 of the swing plate 9 passes the pin 10, that part of the swing plate 9 which is opposed to the latch portion 11 strikes the pin 10 to stop the slider 3. At this point the push on the door is discontinued, and the slider 3 is allowed to slide forward by the force of the spring means 4. At same time, the swing plate 9 is caused to swing by the force of the spring 13 until the latch portion 11, as FIG. 2 shows, catches the pin 10 to lock up the slider 3, so that the door is locked as closed.

If the door is pushed again, the swing plate 9, together with the slider 3, moves a short distance toward the inner end until that part of the swing plate 9 which is opposed to the latch portion 11 strikes the pin 10 to stop the slider 3. The movement of the swing plate 9 toward the inner end of the casing 2 means that the pin 10 is positioned at a point nearer to the front end of the slope portion 12. And, it is possible that the front end of the slope portion 12 is positioned on the pin 10. At this point, the spring plate 9 is freed from the action of the pin 10 and caused to swing by the force of the spring 13. When the front end of the slope portion 12 comes to a position above the pin 10, if pushing the door is stopped, the slider 3 is actuated to slide by the force of the spring means 4, and the swing plate 9, guided by the slope portion 12, moves over the pin 10. As the result, the slider 3 projects outwardly of the casing 2, and as above described, the engagement means 5 releases the coupling means 15. Thus, the door is separated from the body of the box structure and released from the action of the engagement means 5.

In the embodiment described above, the pin 10 is mounted upright in the casing 10 and the swing plate 9 is pivotally supported by a shaft on the slider 3. Conversely, the swing plate 9 may be pivotally supported by a shaft in the casing 2 and the pin 10 may be mounted upright on the slider. In the latter case, however, it is to be noted that the swing plate 9 should be pivotally carried in the casing 2 in the opposite direction from that shown in the drawings.

Figure 8:
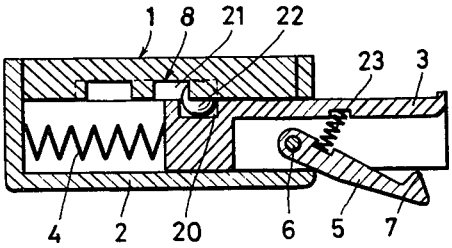
FIG. 8 is a section of another form of locking means.
Figure 9:
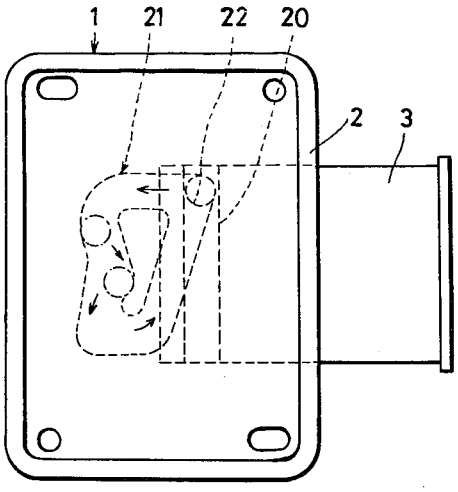
FIG. 9 is a plan view of the locking means shown in FIG. 8.
Figure 11:
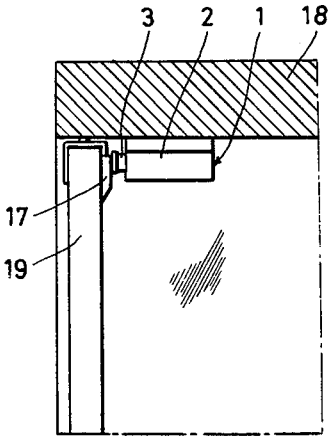
FIG. 11 is a side view showing the closer when in use.
Figure 10:
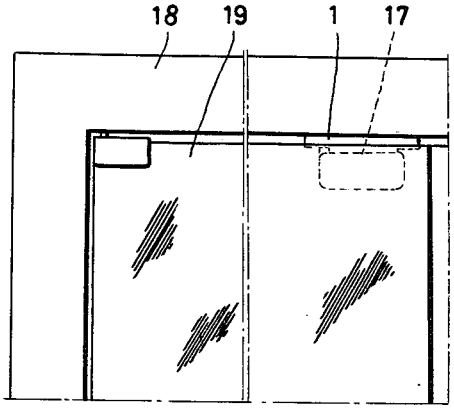
FIG. 10 is a front view showing the closer as it appears when in use.

It is to be understood that the locking means 8 herein described is not limited to the embodiment shown in FIGS. 2 to 5 inclusive. Any known construction of locking means may be used which is so designed that the slider 3 is pushed to be locked up and is pushed again to be released from the lock. Shown in FIGS. 8 and 9 is an example in which an engagement groove 20 is provided on a plane parallel to, and at the right angle to, the direction of slide movement of the slider 3 and a ring-shaped guide groove 21 is provided on the opposite wall surface of the casing 2 or of a plate fixedly attached thereto. In the opposed grooves 20, 21 is inserted a ball 22 of a diameter suitable for movement therealong. That part of the guide groove 21 which is nearer to the inner end of the casing 2 is curved toward the entrance side of the casing 2 and its position varies between its inner peripheral and outer peripheral walls.

When the slider 3 is released from lock, the ball 20 is positioned in the guide groove at a point nearest to the entrance of the casing. As the slider 3 is pushed into the casing 2, the ball 22 is pushed by the engagement groove 20 for movement along the guide groove 21 in the direction of arrow, and when the ball 22 reaches the outer peripheral curved portion of the guide groove 21, at a point nearest to the inner end of the casing, the slider 3 stops its slide movement. If pushing the door is stopped at this point, the ball moves to the inner peripheral curved portion of the guide groove 21, then stops to lock the slider 3. Releasing the slider 3 from lock is accomplished by pushing the slider 22; the ball 22 then moves to the outer peripheral side of the guide groove 21, where the ball is freely movable. When the ball 22 reaches the innermost end of the guide groove 22, the slider 3 stops its movement. If, at this point, pushing the slider 3 is stopped, the ball 22, along with the slider 3, is caused to move to that part of the guide groove 21 which is nearest to the entrance of the casing 2. The slider 3 then projects outwardly of the casing 3 to separate the door from the entrance portion of body of the box structure. The provion of a spring 23 between the slider 3 and the engagement means 5 for separating them from each other, as shown, permits the casing 2 to be mounted vertically or otherwise as desired. Such way of mounting suits the purpose of using the device with a cover or lid to be opened upwardly.

As above described, the closing device is such that an engagement means 5 having a catch projection 7 is pivotally carried by shaft 6 in the slider 3, with the catch projection 7 positioned at the front end side of the slider 3, so that when the slider 3 is pushed into the casing 2, the catch projection 7 is brought into engagement with the counterpart catch member 16 of the coupling means 15 secured to the door. This arrangement coupled with the locking up of the slider, permits secure locking of the door. Therefore, the device eliminates the possibility of the closed door being separated from the slider 3 and opened due to vibration and otherwise, thus positively achieving the object of door closing. The envagement means 4 pivotally supported at one end by shaft in the slider 3 is adapted to swing toward the slider 3 while being supported in the casing 2 and to swing in the reverse direction when released from the casing 2. Therefore, lock and release of the door can be accurately accomplished through the slide movement of the slider 3. Further, the slider 3, when projected outwardly of the casing 2, releases the coupling means 15 instantly upon separation of the door from the body of the box structure. Therefore, no force is required to open the door. The device permits easy door opening without vibration being given to the body of any box structure such as audio rack or the like.

What is claimed is:

1. A closing device for doors and the like, comprising a casing, a slider housed in the casing, said slider outwardly and inwardly slidable relative to the casing and urged by spring means outwardly relative to the casing, locking means provided on the slider in the casing for locking up the slider in the casing if the slider is pushed into the casing and for releasing the slider if the slider is pushed again, engagement means having a catch projection at one end thereof and pivotally supported on a shaft mounted to the slider at the right angle to the direction of slide movement of the slider, said catch projection disposed in opposed relation with the front end portion of the slider, and coupling means interposed between the engagement means and the slider and having at one end thereof a counterpart catch member engageable with the catch projection.

* * * * *